US005819669A

United States Patent [19]

Eyre

[11] Patent Number: 5,819,669

[45] Date of Patent: Oct. 13, 1998

[54] MOTORIZED CONSOLE

[75] Inventor: Clarence W. Eyre, Dry Prong, La.

[73] Assignee: Baker Manufacturing Co., Inc., Pineville, La.

[21] Appl. No.: 867,693

[22] Filed: Jun. 3, 1997

[51] Int. Cl.[6] ..... A47B 9/00

[52] U.S. Cl. ..... 108/147

[58] Field of Search ..... 108/147, 144.11, 108/144.19, 106, 10; 248/188.1, 188.6

[56] References Cited

U.S. PATENT DOCUMENTS

| | | | |
|---|---|---|---|
| 1,243,750 | 10/1917 | Miller | 108/147 |
| 2,532,342 | 12/1950 | Sloane | 108/147 X |
| 2,604,996 | 7/1952 | Smith | 108/147 X |
| 3,140,559 | 7/1964 | Grow et al. | 108/147 X |
| 3,820,176 | 6/1974 | Feiertag | 108/147 X |
| 4,641,067 | 2/1987 | Iizawa et al. . | |
| 4,981,085 | 1/1991 | Watt | 108/147 |
| 5,323,695 | 6/1994 | Borgman et al. | 108/147 |
| 5,370,063 | 12/1994 | Childers | 108/147 |

*Primary Examiner*—Jose V. Chen

*Attorney, Agent, or Firm*—Garvey, Smith & Nehrbass, L.L.C.

[57] ABSTRACT

A motorized console has a work surface that can be moved up and down to accommodate users of different heights while at the same time provide a mechanism for raising and lowering the work surface that is positioned under the surface at a location that does not interfere with the leg room required by large individuals.

14 Claims, 4 Drawing Sheets

MOTORIZED CONSOLE

CROSS REFERENCE TO RELATED APPLICATION

Not Applicable

STATEMENT REGARDING FEDERALLY SPONSORED RESEARCH AND DEVELOPMENT

Not Applicable

FIELD OF THE INVENTION

The present invention relates to motorized computer consoles and more particularly to a motorized computer console adapted to provide ample leg room under the console's computer support surface.

BACKGROUND OF THE INVENTION

Present day motorized computer consoles or other types of vertically movable work surfaces employed by humans often do not provide convenient leg room under such surface, particularly for long legged individuals. The motors, drive shafts, chain drives, gearing and the like occupy relatively large vertical regions under the consoles main work surface, be it for a computer, typewriter, adding machine with or without other equipment. Since often such a unit is used by several people the machine adjustment feature is desirable but as indicated may be a problem for people with long legs.

OBJECTS OF THE INVENTION

It is an object of the present invention to provide a motor drive mechanism for raising and lowering the work platform of a console or the like that provides ample leg room under the work platform.

Another object of the present invention is to provide both vertical and depth dimensions of a motor drive unit and assembly for the work surface of a console that does not interfere with the legs of the user.

Still another object of the present invention is to employ operating mechanisms that are located in both the vertical and horizontal directions at locations under the work surface that together with other elements, are located at sides of the console remote from the user.

BRIEF SUMMARY OF THE INVENTION

A motor is attached to a bracket attached to a rear wall of an upside down L-shaped member extending between two side supports for the console including the work surface. The motor shaft is horizontal and extends in a direction parallel to the rear wall of the unit. A shaft extends between the two side supports parallel to the motor shaft and is chain driven from reduction gearing driven by the motor shaft. Gears are carried on both ends of the shaft and chain drive the mechanism for raising and lowering the console work platform.

Since all major components lie horizontally and because of their nature they can be closely spaced. The space occupied by the mechanism is relatively little and the equipment arrangement is compact. Further none of the heavier elements are supported on the moving; that is, motor driven elements but are on the lower stationary side supports. Thus the motor load is not great and does not have to be overly large.

The above and other features, objects and advantages of the present invention, together with the best means contemplated by the inventor thereof for carrying out the invention will become more apparent from reading the following description of a preferred embodiment and perusing the associated drawings in which:

DETAILED DESCRIPTION OF THE INVENTION

Figure 1:
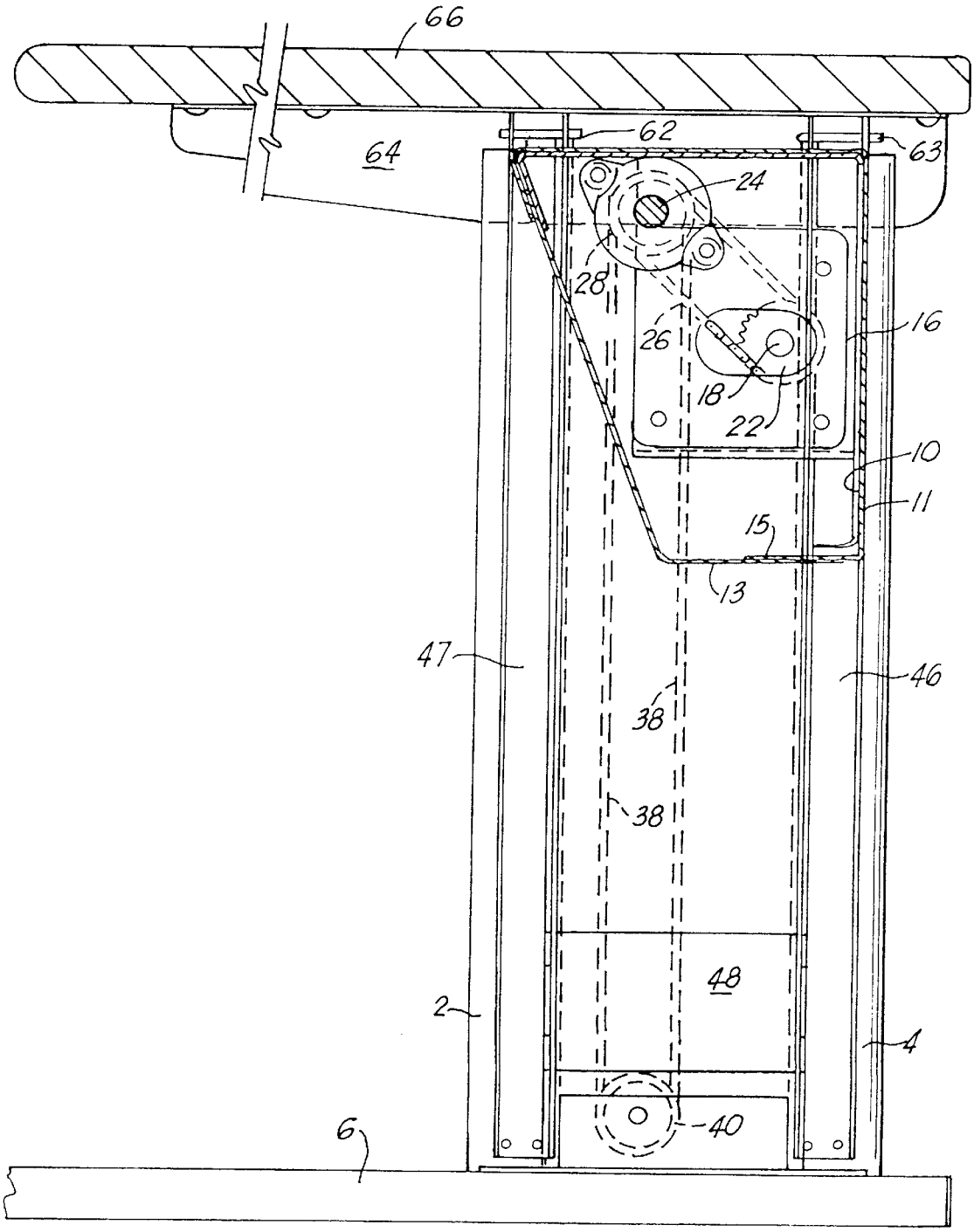
FIG. 1 is a side view in elevation of the structure of the present invention.
Figure 2:
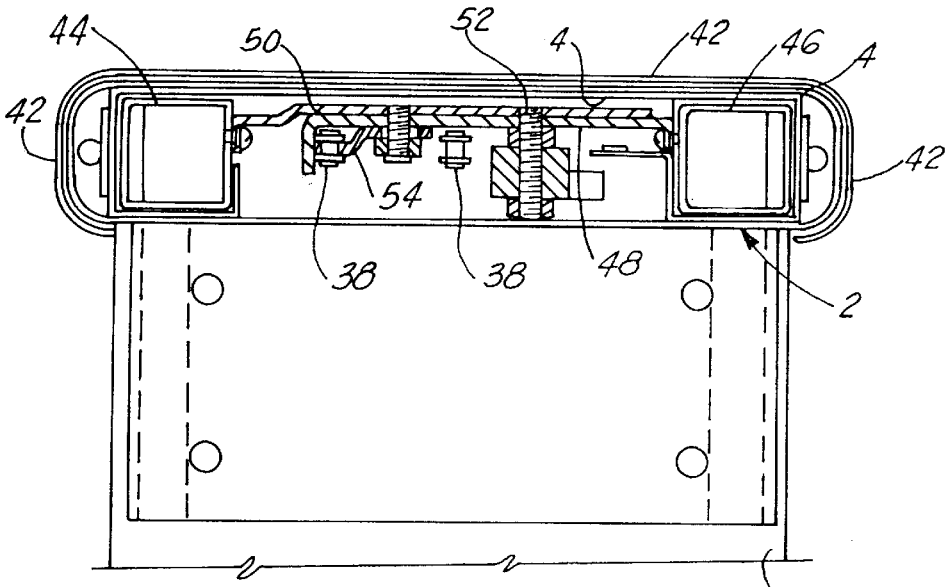
FIG. 2 is a top view of the structure.
Figure 3:
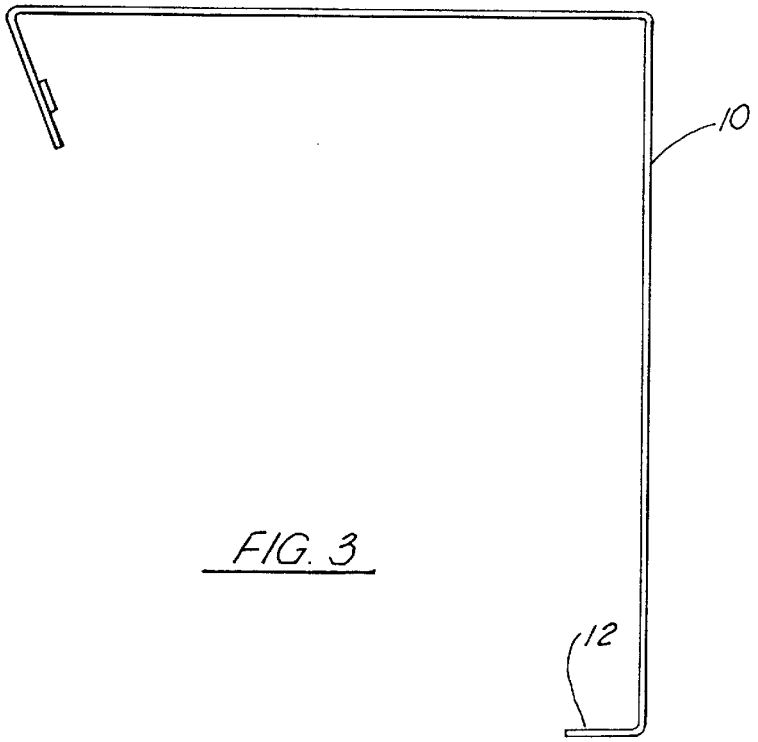
FIG. 3 is a side view in elevation of a member extending between the sidewalls of the structure and providing a rear wall and a support for the work surface of the structure.
Figure 8:
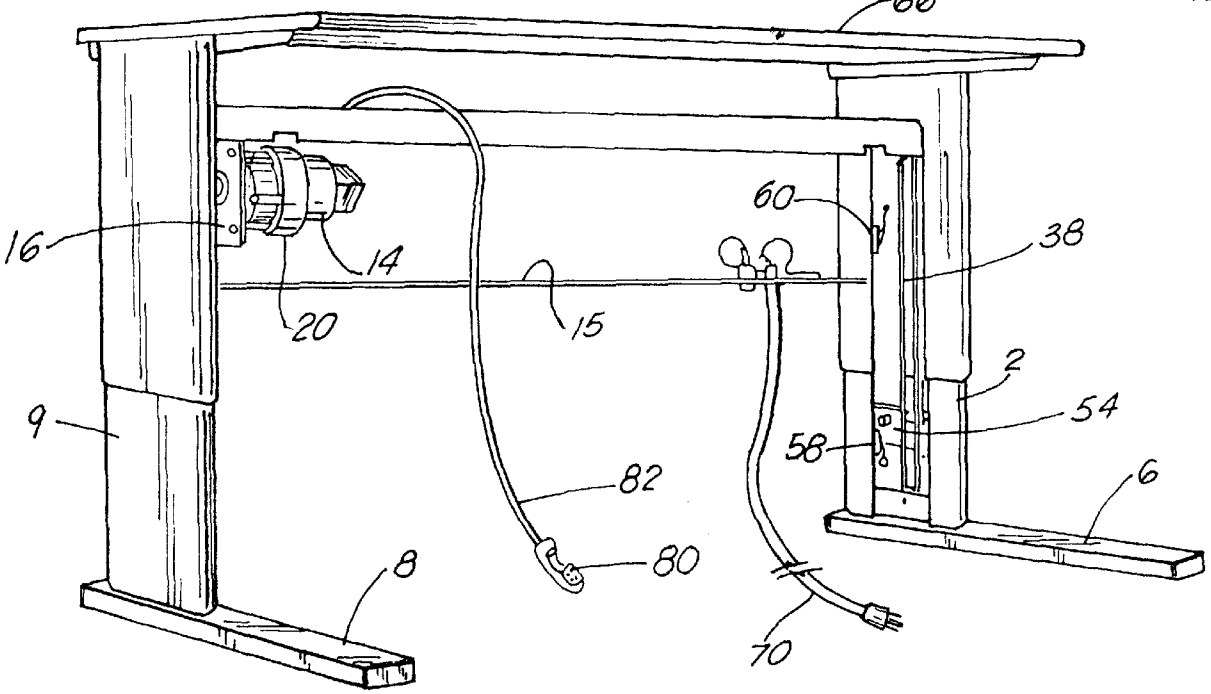
FIG. 8 is a front view in elevation of the console of the present invention.

Referring specifically to FIGS. 1 and 2 of the accompanying drawings, the basic elements of the console comprise side supports one of which is designated by numeral 2 in FIG. 8, feet numbers 6 and 8 in FIG. 8 for the side members, upside down L-shaped bracket 10 for each side (see FIG. 3 for detail of number 10) extending inward and supported on side support 2 and the corresponding support 9 on the other side of the console.

The bracket 10 supports a vertical back wall 11, and a bracket 16 from which the drive motor 14 for the console is supported while the electrical control circuits are mounted primarily on a narrow shelf 15 at the bottom of the wall 11. The members 10 and 11 are identical except for size and support an element 13 screwed to a lower horizontal member 15 of member 11 and wedged between and screwed to the upper ends of members 10 and 11 thus providing a complete enclosure of that part of the drive mechanism that extends between the two sides of the console and which could be contacted by a body member (leg, hand) of the user.

The side support 2 has two generally square posts 44 and 46 with a plate 48 between them adjacent their lower ends and secured as more fully described below, to the underside of a top working surface 66. These elements ride up and down in a side member 4 which serve as a guide for the elements 44 and 46. The dimensions of the members 44, 46 and 4 are such as to substantially prevent lateral movement of the members 44 and 46. The member 11 extends between and is supported between the two sides of the members 2 and 9 on bracket 10.

Referring to FIG. 8, a self-braking ac electric motor 14 is supported on a bracket 16 that extends forwardly from the vertical surface of the bracket 10. The motor 14 is carried on a gear reduction housing 20 with the shaft of the motor extending into the housing and the shaft of reduced rotational velocity extending out of the other side of the housing 20. A sprocket 22 is secured to the end of the housing shaft 18 to drive a shaft 24 via sprocket 22, a chain 26 and a further sprocket 28 secured to the shaft 24. The axis of the shaft 24 is parallel to the axis of the shaft 18 of the motor 14 and is supported in and extends through the opposite sides of the lower side members 2 and 9.

Figure 4:
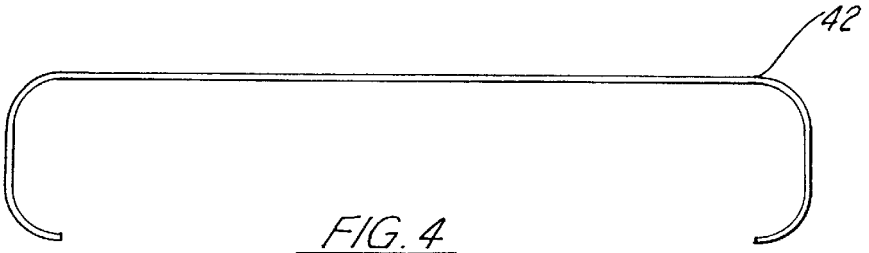
FIG. 4 is a top view of a shield employed.

Sprocket 30 is disposed on one end of shaft 24 external to the side member 2, a corresponding sprocket is secured to the other end of the shaft. A sprocket 39 is supported on and is external to side support 2 adjacent the bottom of the console. A chain 38 extends from sprockets 30 to 39. Thus rotation of the motor causes the chains and associated sprockets (there being the same arrangement of sprockets and chains associated with side support 9) to be rotated. To isolate the chains and associated sprockets from adjacent outside regions, a shroud 42, see FIGS. 1 and 4, envelops the outer sides of the side support and extend across the back of the console.

Figure 5:
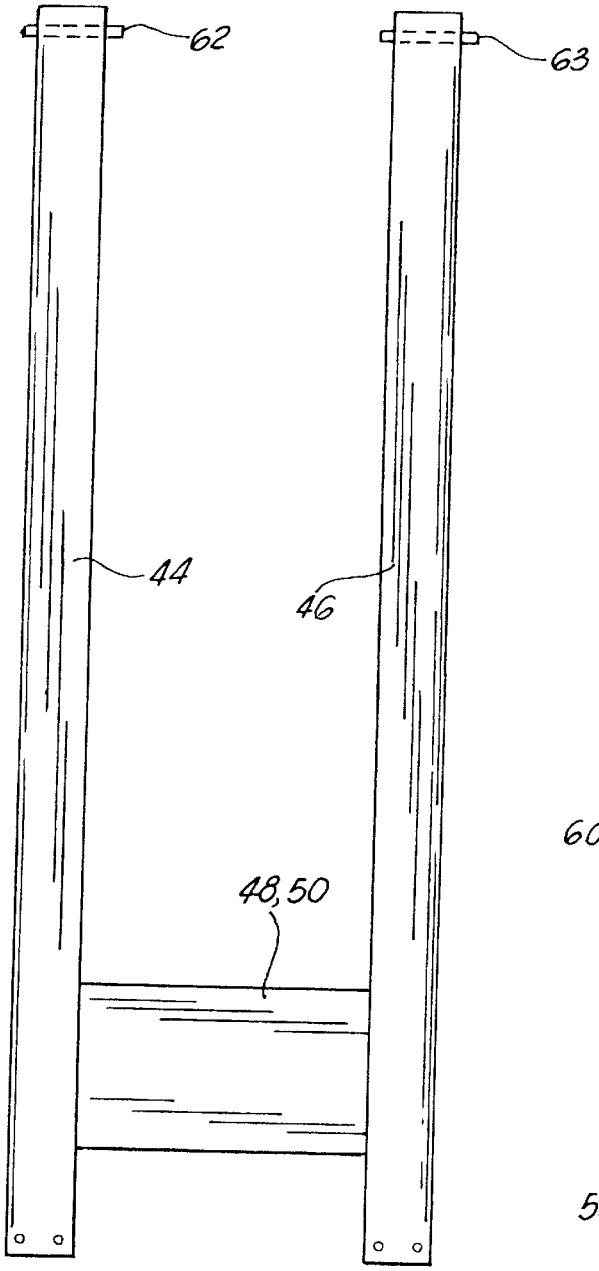
FIG. 5 is an elevational view of the basic elements of one of the sidewalls of the structure.
Figure 6:
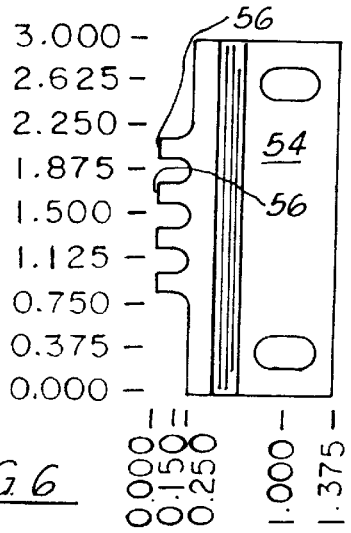
FIG. 6 is a member for engaging a chain so as to move with it.
Figure 7:
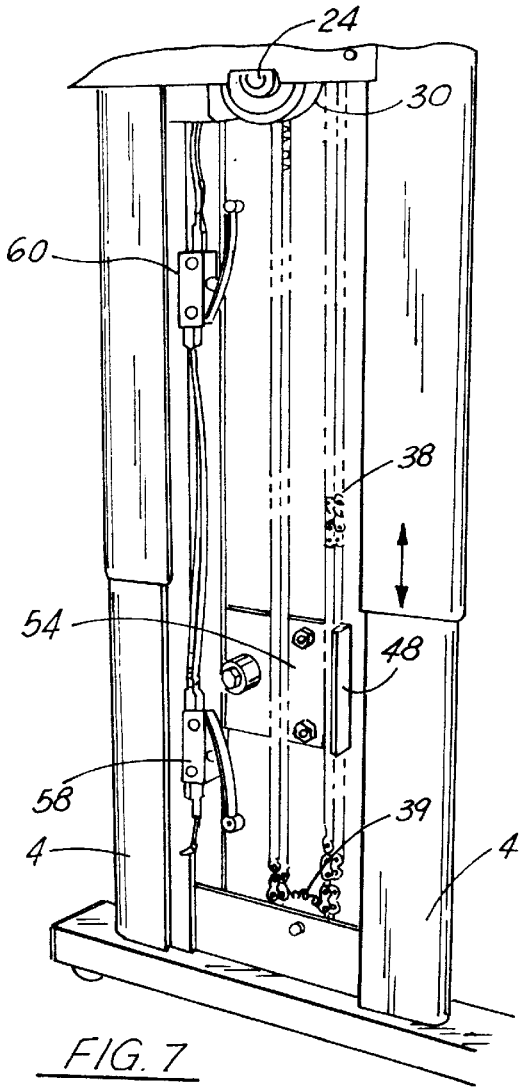
FIG. 7 is a front view in elevation of the mechanism in a sidewall for raising and lowering the working surface.

Referring to FIGS. 1, 5 and 6 of the accompanying drawings, the vertical square tubes 44 and 46 are located at the front and back edges on each side of the console immediately inside of the shroud 42 and are secured to one another by overlapping lifting brackets 48 and 50 held together by bolt 52 (only one illustrated) and welded respectively to tubes 44 and 46. Bolted to the lifting brackets 48 and 50 by bolt 52 is a chain clamp 54 having teeth 56 that fit between the teeth of the left leg of the chain (as viewed in FIGS. 2 and 7) so that as the chain moves up and down the chain clamp 54 moves up and down and carries the lifting brackets 48 and 50 with it as well as tubes 44 and 46.

The lifting brackets carry a roller extending outwardly toward the interior of the console that is positioned to engage limit switches 58 and 60, to end downward and upward movement, respectively, as described subsequently.

As seen in FIG. 5 floating nuts 62 and 63 at the top of tubes 44 and 46 engage downwardly projecting brackets 64 from the bottom of the working platform 66. Floating nuts are employed to accommodate minor side movements of the elements.

In summary when the motor 14 is energized the chain 26 drives the sprocket 28, the shaft 24, the sprocket 30, the chain 38 which in turn moves the tubes 44 and 46 up or down to raise or lower working platform 66. This same function is repeated on the other side of the console.

Figure 9:
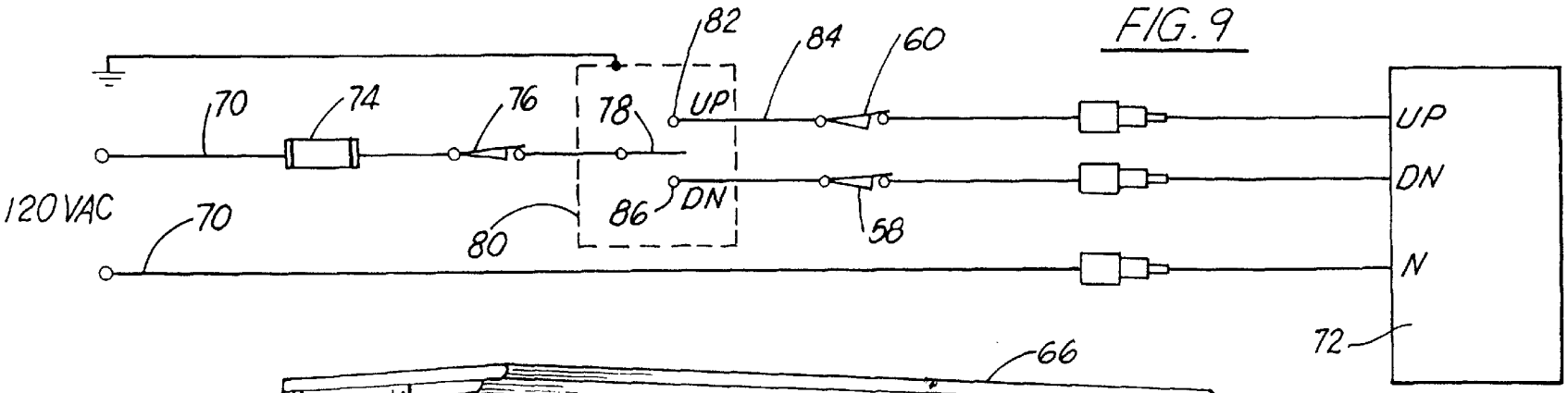
FIG. 9 is a circuit diagram of the control of the motor.

Referring now to FIG. 9 of the accompanying drawings, the circuit diagram of the motor control is illustrated. Voltage at 120 volts is supplied across leads 70; the lower lead of FIG. 9 being connected to the neutral lead on a motor terminal 72. The upper lead 70 is connected through a 250 volt fuse 74 and a normally closed switch 76 to the movable center contact 78 of an up/down rocker switch 80. To produce upward movement of the work platform 66 the contact 78 is moved into contact with terminal 82 connected via lead 84 and limit switch 60 to the "up" terminal of the motor. When the platform has reached its up limit, switch 60 is opened and upward movement is terminated.

If the contact 78 is moved into contact with down terminal 86, energy is supplied through limit switch 58 to the "down" terminal of the motor and the platform is moved downwardly until switch 58 is opened. The switch 80 is located wherever is convenient and can be foot or hand operated. The preference is that of the user since the switch 80 is carried on a long cable 82.

The ac motor in the preferred embodiment set forth herein is a reversible PSC of the Von Weise Gear Co. of ⅙ horsepower. It is a self-braking motor for quick stops. The motor operates at approximately 1460 rpm and the output of the reduction gears is 9.3 rpm under load and 10.9 under no load.

Once given the above disclosure, many other features, modifications and improvements will become apparent to the skilled artisan. Such features, modifications and improvements are, therefore, considered to be a part of this invention, the scope of which is to be determined by the following claims.

I claim:

1. A motorized console providing ample leg room for the user comprising:

a) a console frame having a fixed base, generally vertical spaced apart side members and a top;

b) a drive shaft extending between the side members;

c) a drive mechanism that engages the drive shaft for raising and lowering the top by rotating the drive shaft, said drive mechanism including left and right endless chains;

d) each of said side members including a pair of vertical supports having upper and lower ends spaced apart front to back of the console and connected to said top for elevating and lowering movement therewith relative to the base;

e) a structural member extending between said side members adjacent their upper ends;

f) said drive mechanism secured to said structural member;

g) said drive shaft having drive shaft ends and means at both said ends for driving said endless chains; and h) means for producing vertical movement of said side members upon movement of said chains.

2. A motorized console according to claim 1 wherein said drive mechanism is secured to said structural member adjacent the upper ends of said vertical supports.

3. A motorized console according to claim 2 wherein said console defines a stand with a pair of spaced apart feet and an opening therebetween to be occupied by a user's feet, said stand supporting each of said side members for substantially vertical movement only.

4. A motorized console according to claim 1 wherein said drive mechanism is an electric motor.

5. A motorized console according to claim 4 further comprising a rocker switch for controlling the direction of rotation of said drive mechanism and limit switches to limit vertical movement of said top.

6. The motorized console of claim 4 wherein said electric motor has a self-braking mechanism.

7. A motorized console comprising:

a) a frame having a pair of spaced apart feet with a leg space therebetween for placement of a user's legs thereinto during use;

b) a pair of elevating sidewall portions carried by the frame on opposite sides of the leg space and extending generally vertically above the feet respectively;

c) a work platform supported by the sidewall portions;

d) a rotary drive shaft that extends across the frame above the space, having a pair of drive shaft end portions;

e) a pair of upper drive sprockets mounted respectively at the end portions of the drive shaft, on opposite sides of the leg space;

f) a pair of lower drive sprockets mounted respectively near the pair of feet of the frame and on opposite sides of the knee space;

g) a pair of endless drive chains, each engaging a pair of the sprockets including a left chain that engages a left upper drive sprocket and a left lower drive sprocket and a right chain that engages a right upper drive sprocket and a right lower drive sprocket;

h) chain clamps that attach each endless chain to a respective elevating sidewall portion so that when the chains move, the clamps and sidewall portions travel therewith;

i) a drive mechanism for rotating the drive shaft; and j) wherein when the drive shaft rotates in a selected rotational direction, the chains and sprockets rotate to selectively raise or lower the chain clamps and sidewall elevating portions.

8. The motorized console of claim 7 wherein the side wall portions are comprised of a pair of spaced apart vertical members connected by a transverse member.

9. The motorized console of claim 7 wherein the drive mechanism includes an electric motor.

10. The motorized console of claim 9 wherein the electric motor is a self-braking motor.

11. The motorized console of claim 9 further comprising limit switches for limiting the upper and lower elevational position of the sidewalls.

12. The motorized console of claim 7 wherein the frame includes an upper end portion with a support portion that holds the drive mechanism.

13. The motorized console of claim 7 further comprising means for limiting the upper and lower elevational position of the sidewalls.

14. The motorized console of claim 7 wherein the drive mechanism connects to the drive shaft with a short endless chain that is much shorter in length that the length of either of the pair of endless chains.

* * * * *